United States Patent [19]

Fruzzetti et al.

[11] Patent Number: 4,820,220

[45] Date of Patent: Apr. 11, 1989

[54] SURFBOARD TETHER

[76] Inventors: Bradley E. Fruzzetti, 21462 Bradford Dr., Castro Valley, Calif. 94546; Micheal Jack, 417 Sunset Rd., Alameda, Calif. 94501

[21] Appl. No.: 102,827

[22] Filed: Sep. 23, 1987

Related U.S. Application Data

[63] Continuation of Ser. No. 745,449, Jun. 17, 1985, abandoned.

[51] Int. Cl.[4] ..... A63C 15/06

[52] U.S. Cl. ..... 441/74; 24/115 K

[58] Field of Search ..... 114/39.2, 172; 441/60, 441/65, 73-75; 24/115 K, 135 R

[56] References Cited

U.S. PATENT DOCUMENTS

| | | | |
|---|---|---|---|
| 3,802,011 | 4/1974 | Castagnola | 441/75 |
| 4,072,113 | 2/1978 | Thurstoni | 24/115 K |
| 4,107,806 | 8/1978 | Newland | 441/75 |
| 4,241,916 | 12/1980 | Palm | 24/115 K |
| 4,267,615 | 5/1981 | Nealy | 441/75 |

FOREIGN PATENT DOCUMENTS

| | | | |
|---|---|---|---|
| 0128526 | 12/1984 | European Pat. Off. | 441/75 |
| 3230464 | 3/1984 | Fed. Rep. of Germany | 441/75 |

*Primary Examiner*—Joseph F. Peters, Jr.
*Assistant Examiner*—Clifford T. Bartz
*Attorney, Agent, or Firm*—George W. Wasson

[57] ABSTRACT

A flanged anchor is embedded in a surfboard and has a non-circular recess. A non-circular retainer fits into the recess but leaves a passageway for a cable which comes in through the passageway and loops around a screw, optionally key-operated, that engages and holds the retainer in the anchor.

2 Claims, 2 Drawing Sheets

SURFBOARD TETHER

CROSS-REFERENCES TO RELATED APPLICATIONS

This application is a continuation of application Ser. No. 745,449, filed June 17, 1985, now abandoned.

BRIEF SUMMARY OF THE INVENTION

For use in tethering surfboards, water skis and the like, there is provided a flanged anchor embedded flush with the surface of and in the material (usually fiberglass and resin) of the surfboard. There is a non-circular retainer held in a non-circular recess in the anchor by a screw engaging a threaded plate in the anchor. A cord for attaching to an external object is passed between the anchor and the recess and loops around the screw. The screw may be made rotatable only by a special key.

PRIOR ART

No particularly pertinent prior art is known to the applicants, particularly with respect to a fiberglass and plastic body such as a surfboard or the like.

DETAILED DESCRIPTION

Figure 1:
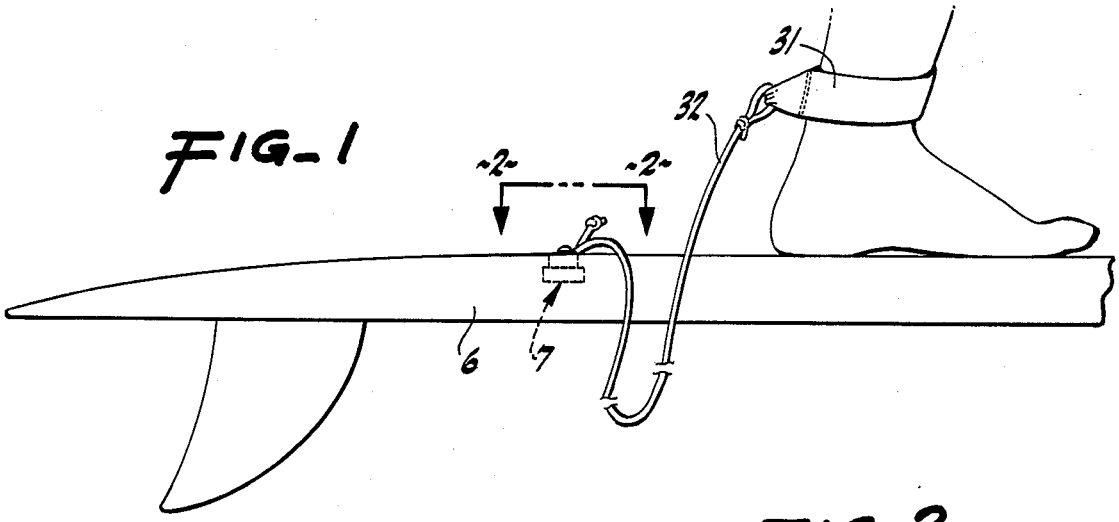
FIG. 1 is a side elevation, portions being broken away, of a surfboard with the tether of the invention incorporated therewith and shown in use.
Figure 2:
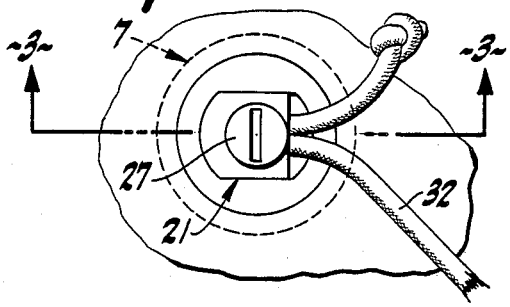
FIG. 2 is a detail in plan of the structure of FIG. 1, the plan being taken as indicated by the lines 2—2 in FIG. 1.

While the structure disclosed herein is primarily intended for use in connection with surfboards and the like, it also can readily be utilized in other comparable environments, and there is no intention of limiting the disclosure simply to surfboards.

In a typical instance and in one form of the device, there is afforded a surfboard 6. This is usually a streamlined, plank-like object comparable in size to the user and usually fabricated of fiberglass and synthetic resin or plastic of some nature. In use, the surfboard 6 often parts company with the rider and may not only be difficult to retrieve, but may sometimes be dangerous if it gets out of control by the user.

For those and other reasons, we preferably provide an anchor 7. This is preferably a molded plastic body having a generally circular cylindrical upper section 8 and a similar but enlarged lower circular cylindrical section 9, constituting a flange. These sections are largely symmetrical about an axis 11. The anchor 8 is installed in the surfboard either at manufacture or later on by providing a suitable recess therefore which is backfilled with a suitable filler and adhesive material. The anchor is set flush with the board surface and is firmly secured thereto but does not itself protrude appreciably and is out of the way.

Figure 5:
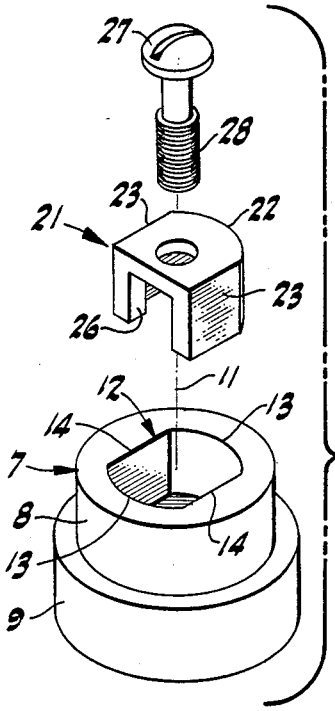
FIG. 5 is an exploded view in isometric perspective of the various portions of the tether itself as shown in the preceding figures.

The interior of the upper portion of the anchor has, as especially shown in FIG. 5, a central, non-circular recess 12 having a pair of arcuate side walls 13 and a pair of chordal side walls 14. The recess extends only partway through the anchor and is also bounded at the bottom by a wall 16 lying just above an installed metal plate 17. The anchor is also formed with a through circular passage 18 symmetrical with the axis and in effect continuing the recess 12. The lower end of the passage 18 is blocked off by an inset cover 19 preferably of metal.

Figure 3:
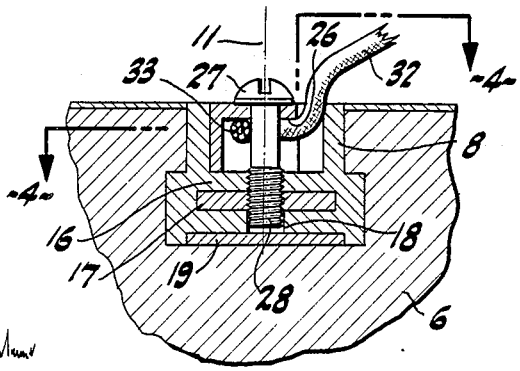
FIG. 3 is a cross-section with portions being broken away, the plane of section being indicated by the line 3—3 of FIG. 2.
Figure 8:
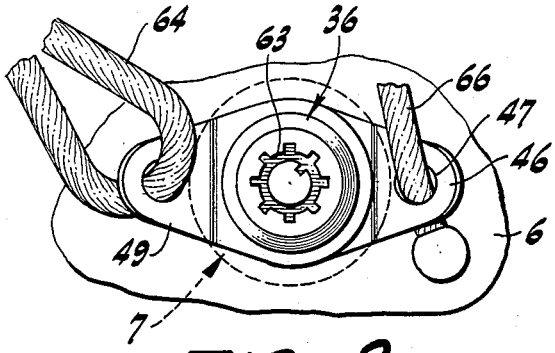
FIG. 8 is a plan of the structure illustrated in FIG. 7.
Figure 7:
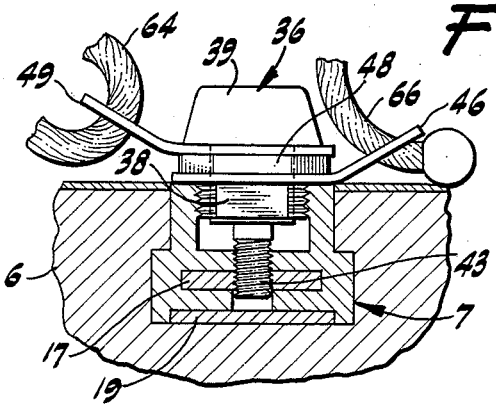
FIG. 7 is a cross-section, the plane of which is indicated by the line 7—7 of FIG. 6.

Designed to interfit with the anchor and especially to occupy a part of the recess 12 is a retainer 21 having an arcuate wall 22 effective to match either of the arcuate walls 13 and having side walls 23 adapted to match the straight walls 14. Some transverse dimensions of the retainer, however, are shorter than the dimensions of the recess, so that there remains an opening or passageway 26 (FIG. 3) between the anchor and the retainer when they are nested.

To hold the retainer in the anchor in the position indicated, there is provided a screw 27 of the usual sort having the customary screwdriver head and also having threads 28 designed to interengage with similar threads on the interior opening of the plate 17.

In operation, the user of the surfboard wears an anklet 31 or the like to which a cable 32 is attached. The cable at one end has a loop 33 (FIG. 3) which can be passed between the retainer and the anchor before they are assembled and can fit around the shank of the screw 27. The screw is then interengaged with the threads in the plate 17 and is tightened home. When that occurs, the parts are nested and the cable may be pinched and is firmly anchored in the passageway. The anklet 31 and the surfboard 6 are flexibly interconnected.

To disconnect the arrangement, any sort of a screwdriver or even the bow of an available key can be utilized to unscrew the screw 27 and release the retainer from the anchor so that the cable bow can be withdrawn and the surfboard and the user disconnected.

Usually the screw 27 is sufficient for ordinary security, but in some areas it is advisable to utilize a more sophisticated key-type locking arrangement. The general construction of the device is the same as before but with certain modifications as to the screw and its immediate environment.

Figure 9:
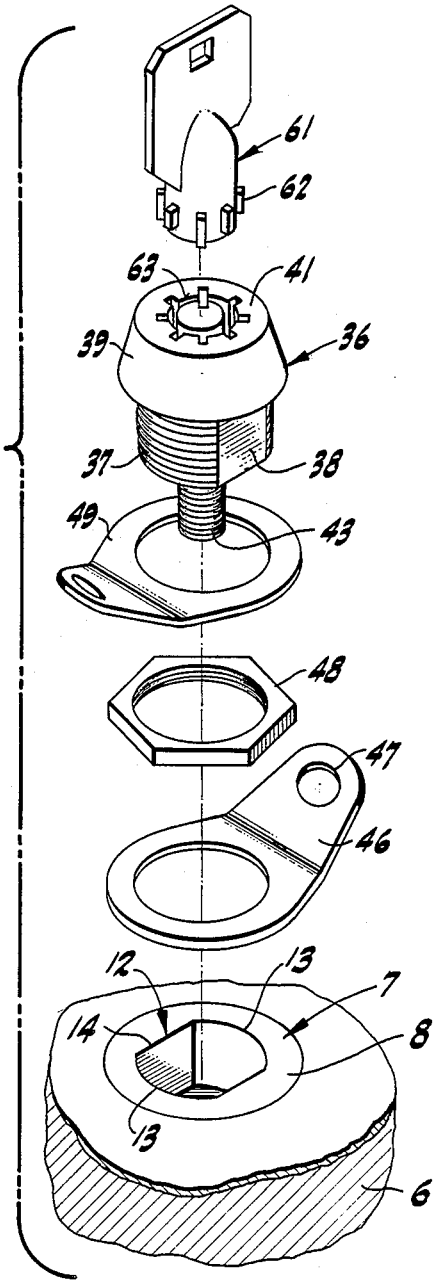
FIG. 9 is an exploded view in isometric perspective of the structure disclosed primarily in FIGS. 6, 7 and 8.

As particularly shown in the exploded view, FIG. 9, a different form of retainer 36 is utilized. This has the same rounded ends 37 and flat sides 38 as before but is of a full dimension and terminates upwardly in a frustoconical cap 39 having a flat surface 41.

Designed to proceed axially through the generally hollow retainer 36 is a screw 43 engageable with the threaded plate 17 as before and effective to position the retainer in the hollow interior of the anchor 8.

Figure 6:
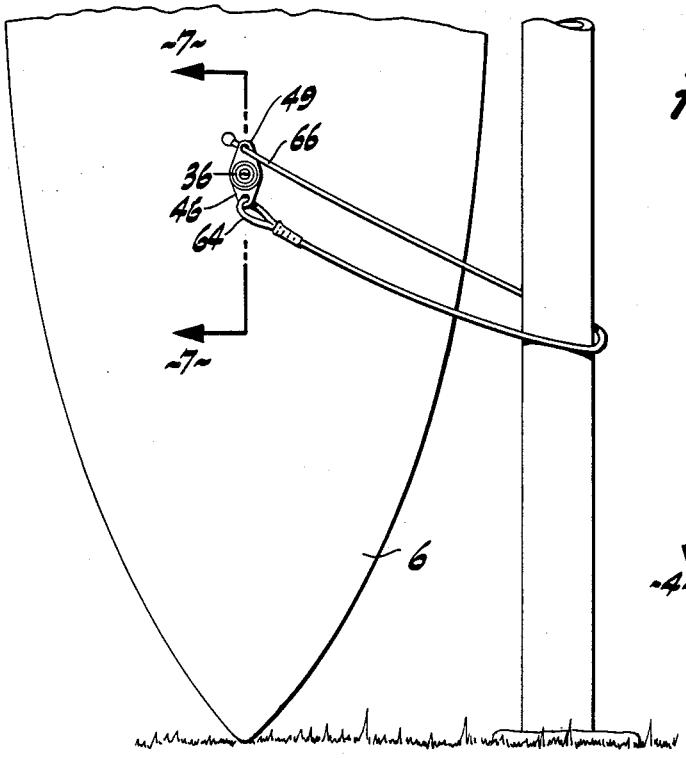
FIG. 6 is a plan of the structure shown in FIG. 1 but looped to a firm anchor and not in surfing use.
Figure 4:
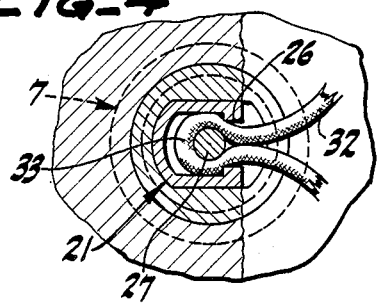
FIG. 4 is a plan in part and a section in part of the structure illustrated in FIG. 3, the planes of the view being indicated by the lines 4—4 of FIG. 3.

This structure is assembled in the anchor 8 by first positioning a tab 46 having an aperture 47 therein and then positioning a nut 48 against the tab 46. Another tab 49 like the tab 46 is then positioned, and the retainer is then positioned along the axis. A key 61 having one internal and several external wards 62 thereon is introduced through an appropriately contoured keyway 63 and arrives at an unwarded or clear space within the member 39, so that upon rotation of the key the bolt 43 or screw is rotated by the inner ward and is interengaged with the threaded plate 17, as before. When the nut 48 and the remaining parts are all tightened, the key 61 is removed. The tabs 46 and 49 provide a suitable structure for receiving the opposite ends 64 and 66 of a cable going to any suitable point, either to the user or, as shown in FIG. 6, around a parking post to avoid theft.

The general operation, installation and use of the modification shown in the latter figures is the same as that of the modification shown in the earlier figures, except that a more elaborate key-operated bolt is utilized.

We claim:

1. A device for securing a tether to a surfboard comprising (a) an anchor block imbedded in said surfboard, said anchor block having a non-circular internal recess in the upper portion thereof accessible at the exterior surface of said surfboard and a threaded perforation at the lower portion thereof, (b) a retainer having a portion of its exterior similarly non-circular to said recess in said anchor block said retainer having a cylindrical portion of its exterior having an external threaded surface, (c) a perforated tab having an aperture therein adapted to surround said threaded portion of said retainer, (d) a nut engaging said tab and said threaded portion of said retainer and adapted to secure said perforated tab to said retainer while permitting said perforated tab to rotate about said retainer at said aperture, (e) a tether attached to said tab at said perforation, (f) said retainer having a bolt, a threaded portion on said bolt threadedly engaging said threaded perforation of said anchor block, (g) and means at the exterior of said retainer defining a keyway for a key engageable with said bolt the use of said key enabling the rotation of said bolt with respect to said retainer and said anchor block whereby said bolt is secured to said threaded perforation in said anchor block and said tether is secured to said surfboard.

2. A device for removably securing a cable to a mobile object comprising:

(a) an anchor fixed to said object, said anchor having a non-circular recess opening through the top of said anchor, said anchor being defined by (i) a bottom wall having an internally threaded axial opening therethrough, (ii) an opposing pair of flat axially extending anchor recess side walls, (iii) and a pair of curved axially extending anchor recess end walls;

(b) a non-circular, retainer having a top, a bottom and a body portion, said body portion adapted to fit into said non-circular recess in said anchor, said body portion having a pair of flat spaced-apart axially extending retainer exterior side walls, and axially extending curved exterior retainer end walls between said top and bottom, (i) said retainer being adapted to cooperate with said flat and curved recess walls of said anchor, (ii) and said retainer side walls being shorter than said anchor side walls to leave a continuous gap between said bottom of said anchor and said axially extending end of said retainer within said recess;

(c) an outstanding cap on said retainer at said top, said cap having radially extending wards defining a keyway;

(d) a perforated tab having an aperture therein disposed around said retainer body portion below said cap and adapted to be nonreleasably engaged by said cable to secure said cable to said anchor, said tab being adapted (i) to nonreleasably engage said cable, (ii) and to rotate freely about said retainer body portion at said aperture;

(e) said retainer having a bolt adapted to pass axially through said gap between said retainer and said anchor to engage said threaded axial opening in said anchor bottom wall, said bolt having (i) a head adapted to be disposed in said retainer below said cap, whereby a mating key having a complementary construction to said keyway in said cap and an axially extending radial ward thereon will pass axially into said retainer cap and into interengagement with said bolt to provide for rotation of said bolt within said anchor bottom wall to removably secure said cable to said mobile object.

* * * * *